US011649647B2

(12) United States Patent
Bunch et al.

(10) Patent No.: US 11,649,647 B2
(45) **Date of Patent: *May 16, 2023**

(54) SYSTEM AND DEVICE FOR LEVELING AND ALIGNING TILES AND METHOD FOR USE OF SAME

(71) Applicant: Acufloor, L.L.C., North Richland Hills, TX (US)

(72) Inventors: Clinton D. Bunch, Keller, TX (US); Joshua A. Bunch, Keller, TX (US)

(73) Assignee: Acufloor, LLC, North Richland Hills, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/818,593

(22) Filed: Aug. 9, 2022

(65) Prior Publication Data

US 2022/0389725 A1 Dec. 8, 2022

Related U.S. Application Data

(63) Continuation of application No. 17/667,738, filed on Feb. 9, 2022, now Pat. No. 11,408,186.

(Continued)

(51) Int. Cl.

| | |
|---|---|
| ***E04F 21/00*** | (2006.01) |
| ***E04F 21/22*** | (2006.01) |
| ***E04F 21/18*** | (2006.01) |

(52) U.S. Cl.

CPC ..... *E04F 21/22* (2013.01); *E04F 21/1877* (2013.01); *E04F 21/1894* (2013.01); *E04F 21/0092* (2013.01)

(58) Field of Classification Search

CPC ... E04F 21/0092; E04F 21/22; E04F 13/0892; E04F 21/1877; E04F 21/20;

(Continued)

(56) References Cited

U.S. PATENT DOCUMENTS

| | | | |
|---|---|---|---|
| 3,185,442 | A | 5/1965 | Hemphill |
| D268,804 | S | 5/1983 | Bacon |

(Continued)

FOREIGN PATENT DOCUMENTS

| | | |
|---|---|---|
| AU | 2012101175 | 8/2012 |
| CA | 2892352 | 11/2016 |

(Continued)

OTHER PUBLICATIONS

Pearl Abrasive Co., Tuscan Leveling System, www.pearlabrasive.com.

(Continued)

*Primary Examiner* — Yaritza Guadalupe-McCall

(74) *Attorney, Agent, or Firm* — Scott Griggs; Griggs Bergen LLP

(57) ABSTRACT

A system and device for leveling and aligning tiles and a method for leveling and aligning tiles are disclosed. In one embodiment of the tile leveling system, a tile leveling device includes an upright body having a head and base at opposite ends thereof. The base and the upright body are integral prior to a frangible separation. The tile leveling device is selectively threaded through a line-of-sight opening of a wedge device for use in an operational configuration.

20 Claims, 9 Drawing Sheets

Related U.S. Application Data

(60) Provisional application No. 63/147,554, filed on Feb. 9, 2021.

(58) Field of Classification Search
CPC ..... E04F 15/02022; E04F 21/1844; E04F 15/02005; E04F 21/00; E04F 21/18; E04F 21/08; E04F 21/1838; E04F 13/08; E04F 13/0801; E04F 13/0885; E04F 13/0889; E04F 13/142; E04F 15/02476; E04F 15/08; E04F 21/023; E04F 21/1872
See application file for complete search history.

(56) References Cited

U.S. PATENT DOCUMENTS

| | | | | |
|---|---|---|---|---|
| D269,495 | S | 6/1983 | Finn | |
| 4,397,125 | A | 8/1983 | Gussler | |
| D271,559 | S | 11/1983 | Reimann et al. | |
| D286,008 | S | 10/1986 | Hillinger | |
| 4,688,761 | A | 8/1987 | Wilcox | |
| D336,224 | S | 6/1993 | Terry | |
| 5,603,195 | A | 2/1997 | Cosentino | |
| D421,374 | S | 3/2000 | Montgomery | |
| 6,041,473 | A | 3/2000 | Johnson | |
| D481,625 | S | 11/2003 | Ellsworth | |
| D590,676 | S | 4/2009 | Pickard | |
| 7,603,825 | B2 | 10/2009 | Dohren | |
| 7,621,100 | B2 | 11/2009 | Kufner et al. | |
| 7,690,080 | B1 | 4/2010 | Coffman | |
| D630,077 | S | 1/2011 | Kufner | |
| 7,861,487 | B2 | 1/2011 | Kufner et al. | |
| 7,954,300 | B1 | 6/2011 | Kufner et al. | |
| 7,992,354 | B2 | 8/2011 | Doda, Jr. | |
| 8,079,199 | B1 | 12/2011 | Kufner | |
| 8,181,420 | B2 | 5/2012 | Torrents I Comas | |
| 8,429,878 | B1 | 4/2013 | Hoffman | |
| D683,924 | S | 6/2013 | Wolfenbarger | |
| D720,588 | S | 1/2015 | Pugh | |
| D731,273 | S | 6/2015 | McPeak Ford et al. | |
| 9,045,911 | B2 | 6/2015 | Hoffman | |
| D734,119 | S | 7/2015 | Kufner | |
| 9,260,872 | B2 | 2/2016 | Bunch et al. | |
| D760,566 | S | 7/2016 | Biec | |
| 9,464,448 | B2 | 10/2016 | Hoffman | |
| 9,487,959 | B2 | 11/2016 | Bunch et al. | |
| 9,657,485 | B2 | 5/2017 | Meyers | |
| 9,970,203 | B1 | 5/2018 | Abidov et al. | |
| 9,988,822 | B2 * | 6/2018 | Quesada Barbero | E04F 21/0092 |
| D821,838 | S | 7/2018 | Castellanos | |
| 10,047,530 | B2 | 8/2018 | Bunch et al. | |
| D829,532 | S | 10/2018 | Bunch et al. | |
| D832,680 | S | 11/2018 | Bunch et al. | |
| 10,208,491 | B2 | 2/2019 | Bunch et al. | |
| D850,966 | S | 6/2019 | Laurans | |
| 10,501,947 | B2 | 12/2019 | Bunch et al. | |
| 10,704,274 | B2 * | 7/2020 | Bunch | E04F 21/20 |
| 11,408,186 | B1 * | 8/2022 | Bunch | E04F 21/22 |
| 2008/0236094 | A1 | 10/2008 | Doda | |
| 2010/0263304 | A1 | 10/2010 | Torrents I Comas | |
| 2012/0144773 | A1 | 6/2012 | Mauro | |
| 2013/0055675 | A1 | 3/2013 | Sighinolfi | |
| 2013/0118115 | A1 | 5/2013 | Hoffman et al. | |
| 2013/0247508 | A1 | 9/2013 | Hoffman | |
| 2013/0255182 | A1 | 10/2013 | Kufner | |
| 2014/0033640 | A1 | 2/2014 | Gorton | |
| 2014/0116001 | A1 | 5/2014 | Ghelfi | |
| 2014/0298736 | A1 | 10/2014 | Bunch et al. | |
| 2014/0325935 | A1 | 11/2014 | Hoffman | |
| 2014/0325936 | A1 | 11/2014 | Psaila | |
| 2015/0308130 | A1 | 10/2015 | Biec | |
| 2016/0090746 | A1 | 3/2016 | Sighinolfi | |
| 2016/0186449 | A1 | 6/2016 | Lee | |
| 2016/0222679 | A1 | 8/2016 | Bunch et al. | |
| 2016/0326754 | A1 | 11/2016 | Bucsa | |
| 2018/0100315 | A1 | 4/2018 | Volponi | |
| 2018/0347210 | A1 | 12/2018 | Bunch et al. | |
| 2018/0355622 | A1 | 12/2018 | Bunch et al. | |
| 2019/0177986 | A1 | 6/2019 | Bunch et al. | |
| 2022/0251856 | A1 * | 8/2022 | Bunch | E04F 21/1894 |

FOREIGN PATENT DOCUMENTS

| | | |
|---|---|---|
| FR | 2625244 | 6/1989 |
| IT | 102012902096853 | 4/2014 |
| WO | 2013033761 | 3/2013 |

OTHER PUBLICATIONS

Q.E.P. Co., Inc., Lash Tile Leveling Clips and Wedges, 99720/99725, www.qep.com.

Harry Kim—Authorized Officer, Written Opinion of International Searching Authority, PCT/US2022/015830, dated Apr. 4, 2022, 2 pages, Patent Cooperation Treaty PCT, International Searching Authority ISA, Alexandria, Virginia. U.S.A.

Harry Kim—Authorized Officer, International Search Report, PCT/US2022/015830, dated Apr. 4, 2022, 2 pages, Patent Cooperation Treaty PCT, International Searching Authority ISA, Alexandria, Virginia. U.S.A.

* cited by examiner

SYSTEM AND DEVICE FOR LEVELING AND ALIGNING TILES AND METHOD FOR USE OF SAME

PRIORITY STATEMENT & CROSS-REFERENCE TO RELATED APPLICATION

This application is a continuation of U.S. patent application Ser. No. 17/667,738 entitled "System and Device for Leveling and Aligning Tiles and Method for Use of Same" and filed on Feb. 9, 2022, in the names of Clinton D. Bunch et al., now U.S. Pat. No. 11,408,186 and issued on Aug. 9, 2022; which claims priority from U.S. Patent Application Ser. No. 63/147,554 entitled "System and Device for Leveling and Aligning Tiles and Method for Use of Same" filed on Feb. 9, 2021, in the names of Clinton D. Bunch et al.; which are hereby incorporated by reference, in entirety, for all purposes.

TECHNICAL FIELD OF THE INVENTION

This invention relates, in general, to tile installation and, in particular, to a system and device for leveling and aligning tiles and properly spacing tiles during the installation thereof.

BACKGROUND OF THE INVENTION

Tile has become a popular decorative and functional article for use in floors, walls, countertops, and the like. Both professional tile installers and do-it-yourselfers spend a great deal of time aligning and leveling tiles as they are being placed on a substrate's surface. Proper alignment and leveling of each tile is important for a number of reasons. Improper installation can cause the need for tiles to be replaced in order to prevent a spacing error from propagating across the substrate, aesthetic reasons, and in some instances, safety concerns. A need exists for a device for leveling and aligning tiles and properly spacing tiles.

SUMMARY OF THE INVENTION

It would be advantageous to achieve a device for leveling and aligning tiles and properly spacing tiles. It would also be desirable to enable a mechanical-based solution that furnishes an inexpensive tool that assists professional tile installers and do-it-yourselfers. To better address one or more of these concerns, in one aspect of the invention, a system and device for leveling and aligning tiles and a method for leveling and aligning tiles are disclosed. In one embodiment of the tile leveling system, a tile leveling device includes an upright body having a head and base at opposite ends thereof. The base and the upright body are integral prior to a frangible separation. The tile leveling device is selectively threaded through a line-of-sight opening of a wedge device for use in an operational configuration. These and other aspects of the invention will be apparent from and elucidated with reference to the embodiments described hereinafter.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF THE INVENTION

Figure 1:
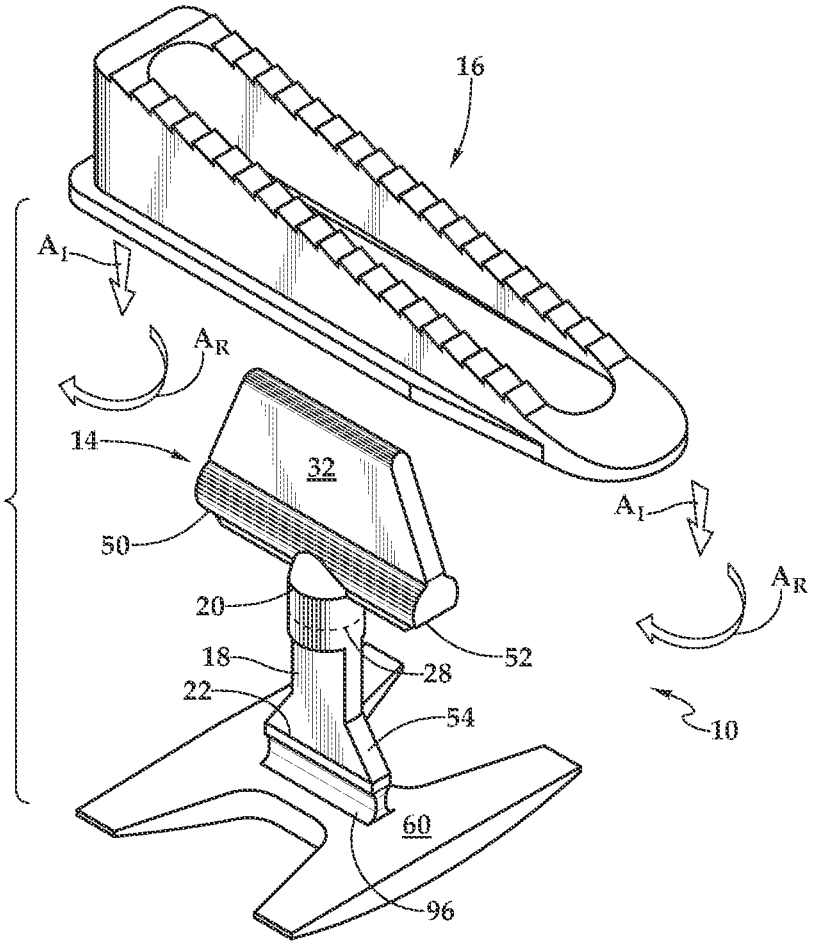
FIG. 1 is a perspective view of one embodiment of a tile leveling device and one embodiment of a wedge device, which together forma tile leveling system, according to the teachings presented herein.
Figure 2:
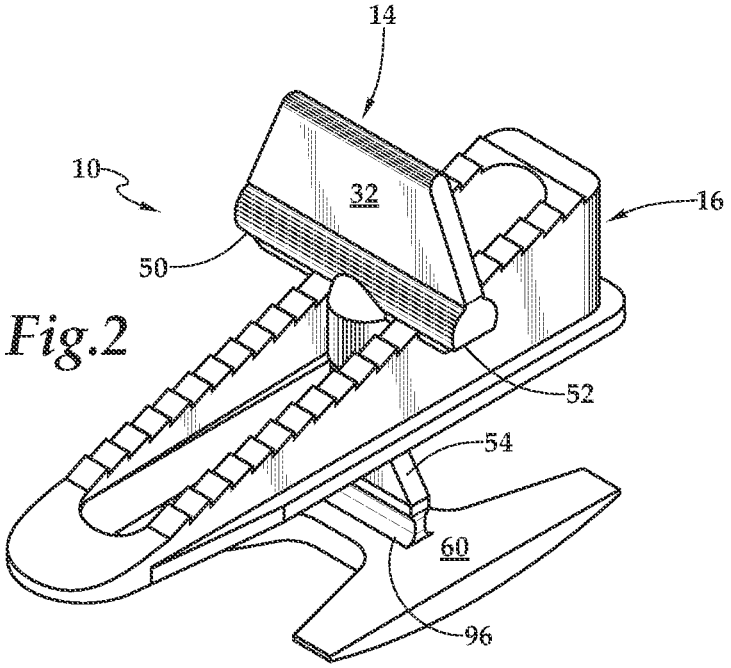
FIG. 2 is a perspective view of one operational configuration of the tile leveling system with the tile leveling device and the wedge device of FIG. 1.
Figure 3:
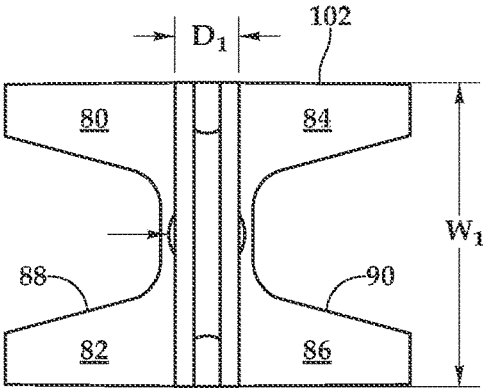
FIG. 3 is a top plan view of the tile leveling device presented in FIG. 1.
Figure 6:
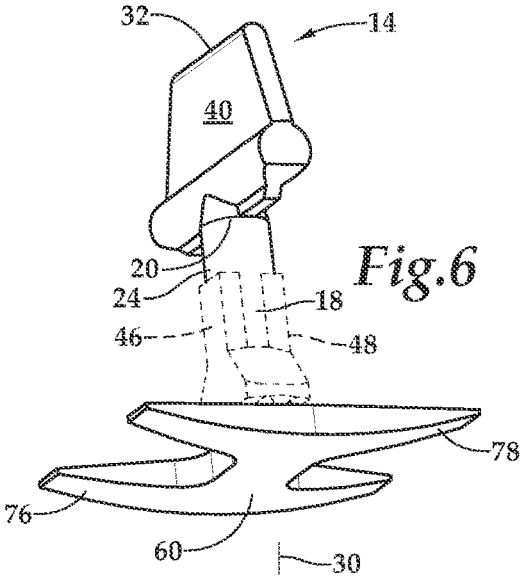
FIG. 6 is a perspective view taken from a bottom front angle of the tile leveling device presented in FIG. 1.
Figure 4:
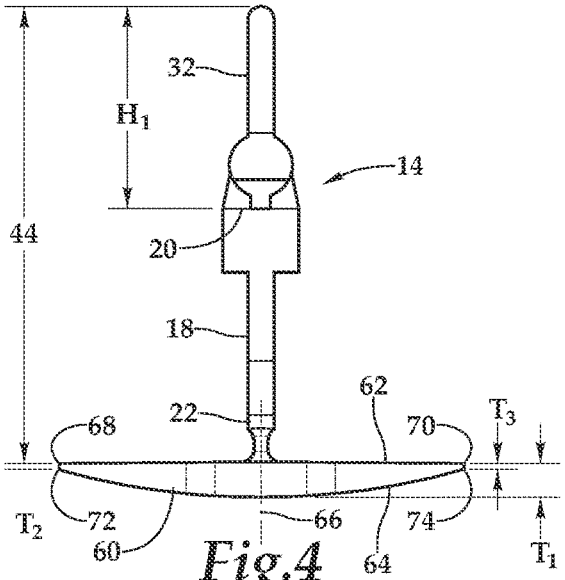
FIG. 4 is a side view of the tile leveling device presented in FIG. 1, which has left-right symmetry.
Figure 7:
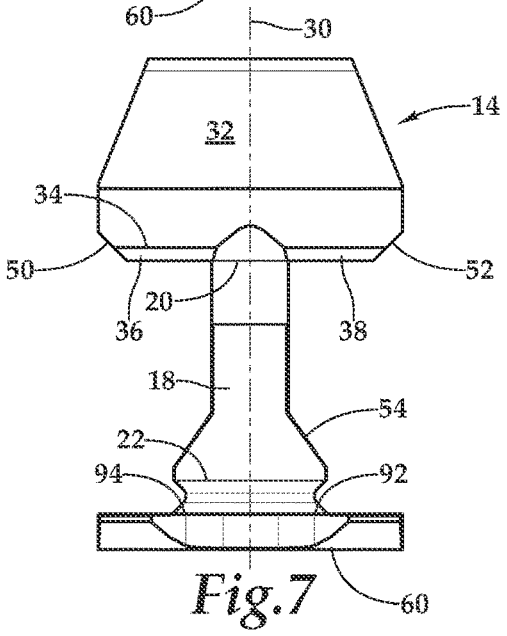
FIG. 7 is a front elevation view of the tile leveling device presented in FIG. 1, which has front-rear symmetry.
Figure 5:
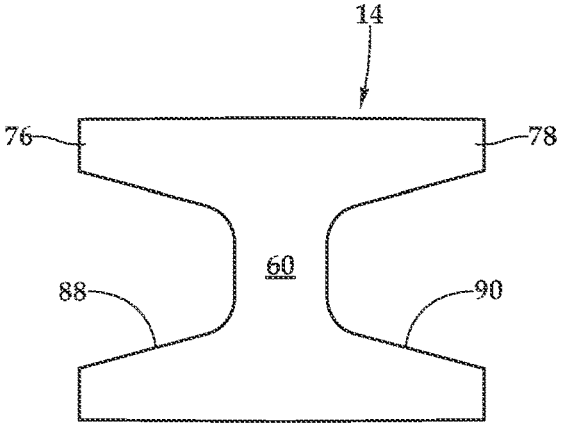
FIG. 5 is a bottom plan view of the tile leveling device presented in FIG. 1.
Figure 8:
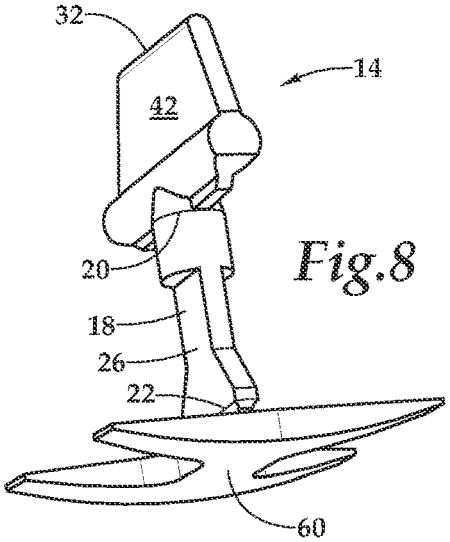
FIG. 8 is a perspective view taken from a front bottom angle of the tile leveling device presented in FIG. 1.
Figure 9:
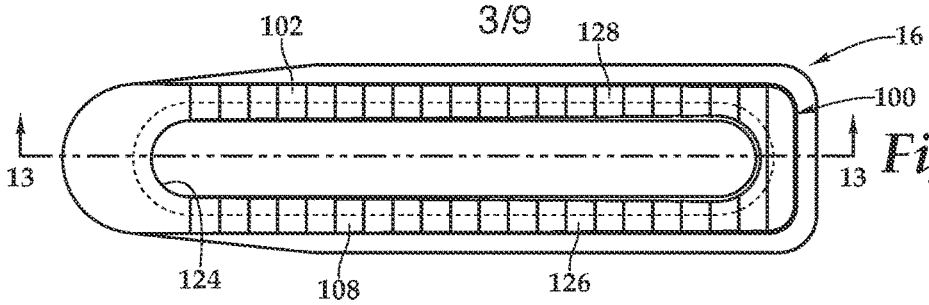
FIG. 9 is a top plan view, with certain features shown with dashed lines, of the wedge device presented in FIG. 1.
Figure 10:
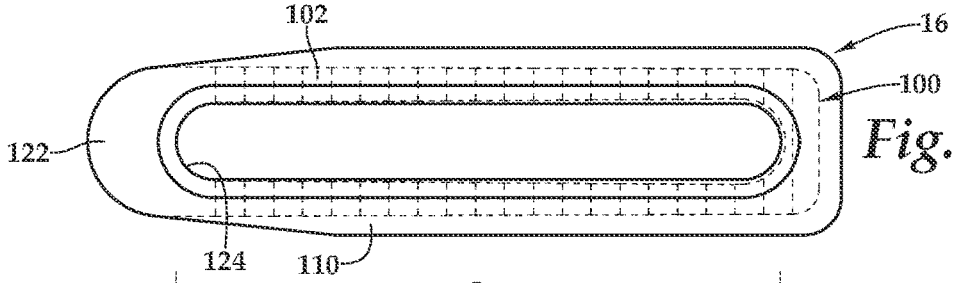
FIG. 10 is a bottom plan view, with certain features shown with dashed lines, of the wedge device presented in FIG. 1.
Figure 11:
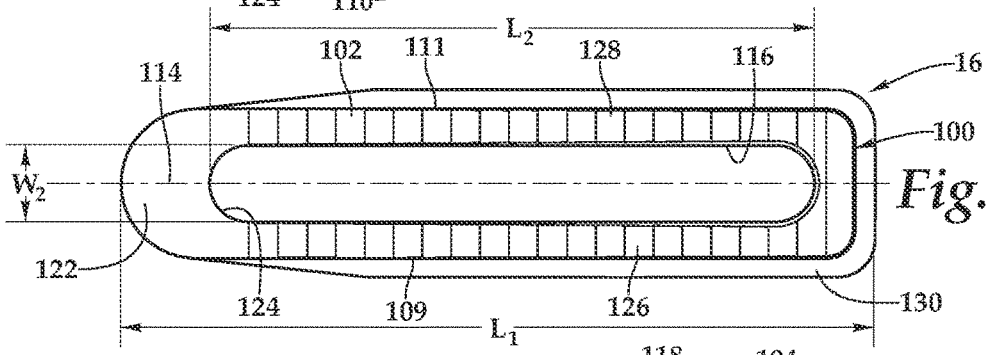
FIG. 11 is a top plan view of the wedge device presented in FIG. 1.
Figure 12:
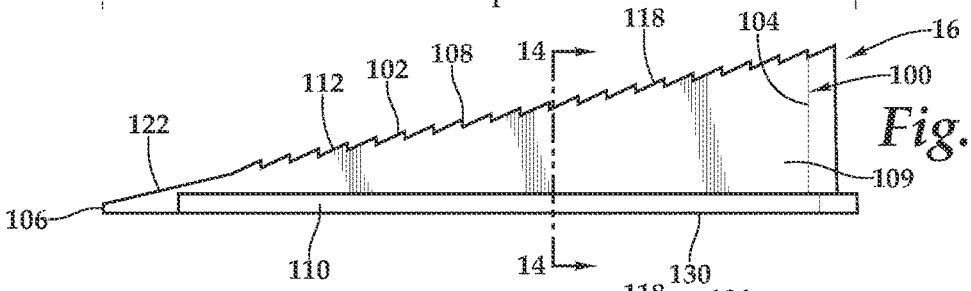
FIG. 12 is a side elevation view, with certain features shown with dashed lines, of the wedge device presented in FIG. 1.
Figure 13:
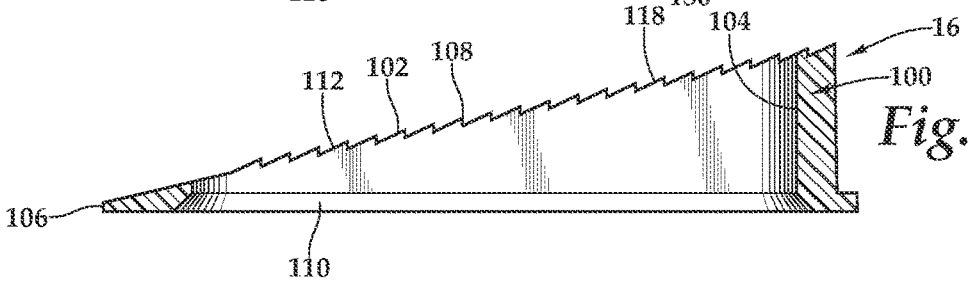
FIG. 13 is a side elevation view of the wedge device presented in FIG. 1, in cross-section along lines 13-13 of FIG. 9.
Figure 14:
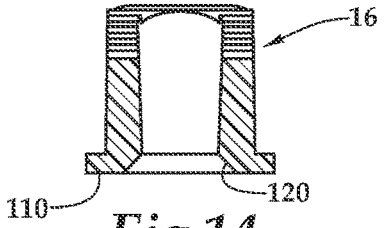
FIG. 14 is a front elevation view of the wedge device presented in FIG. 1, in cross-section along lines 14-14 of FIG. 12.
Figure 15:
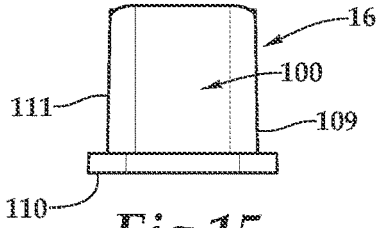
FIG. 15 is a rear elevation view of the wedge device presented in FIG. 1.

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Referring initially to FIG. 1 through FIG. 15, therein is depicted one embodiment of a tile leveling system that is schematically illustrated and generally designated 10. The tile leveling system 10, which includes a tile leveling device 14 and a wedge device 16, is utilized to align and level two, three, or four tiles, for example. The tile leveling device 14 includes an upright body 18 having an upper end 20 and a lower end 22, a front 24, and a rear 26 with a perimeter 28 therearound. In some applications, where the upright body 18 is cylindrical or includes a cylindrical portion, the perimeter 28 may be a circumference or include a circumference. A central vertical axis 30 extends through the upright body 18. A head 32 is coupled to the upper end 20 of the upright body 18. In one embodiment, the head 32 has a guide surface 34, including a left guide surface portion 36 and a right guide surface portion 38. The guide surface 34 faces the direction of the lower end 22 of the upright body 18. Each of the left guide surface portion 36 and the right guide surface portion 38 may include a sharpened surface having a contact edge to provide enhanced contact with the wedge device 16. As shown, the head 32 includes a front 40 and a rear 42 with a head height $H_1$, a head width $W_1$, and a head depth $D_1$. The upright body 18 in combination with the head height $H_1$, the head width $W_1$, and the head depth $D_1$ provide subterminal opposition surfaces 44 in which the palmar surfaces of a thumb and index finger can hold at least one of the upright body 18 and the head 32 therebetween for manipulation of the tile leveling device 14 during use of the tile leveling system 10.

In some embodiments, the tile leveling device may also include a spacer 46 extending from the front 24 of the upright body 18. The spacer 46 is configured to position a tile at a predetermined distance from the tile leveling device 14. Similarly, the tile leveling device 14 may include a spacer 48 extending from the rear 26 of the upright body 18 in order to position a tile at a predetermined distance. It should be appreciated that the spacers 46, 48 may act as spacing pads that are integral with the upright body 18 and may vary in thickness depending on the application. The spacers 46, 48 contribute to furnishing a combination of vertical leveling and joint spacing within a single product.

In some embodiments, the tile leveling device 14 includes respective clipped corners 50, 52 at an intersection of the head 32 and the guide surface 34, which may be transverse, with clipped corner 50 being positioned at the left guide surface portion 36 and the clipped corner 52 being positioned at the right guide surface portion 38. The clipped corners 50, 52 improve and provide clearance between the head 32 and the wedge device 16 during the interconnection of the tile leveling device 14 and the wedge device 16, to better accommodate multiple tile thicknesses and keep the entire assembly as compact as possible. The tile leveling device 14 may also include a flared portion 54 proximate the lower end 22 of the upright body 18. In some embodiments, the flared portion 54 provides greater strength to the upright body 18 while spreading the tension during operation across a frangible breakaway section 94. The flared portion 54 may have a triangular appearance with a tapered edge. In this manner, the flared portion 54 provides additional strength while having a form factor which does not interfere with the selective interconnectivity of the tile leveling device 14 and the wedge device 16. The combination of the additional strength and increased spread of tension provides sufficient support as tiles are manipulated through the installation process. Further, this combination of the additional strength and increase spread of tension provides sufficient support for manipulating tiles of different thicknesses during the tile installation process.

As shown, in the illustrated embodiment, a base 60 is orthogonally coupled to the lower end 22 of the upright body 18. The base 60 includes an upper surface 62 and a lower surface 64 extending from a midline 66 of the base 60 to the front 24 of the upright body 18 and the rear 26 of the upright body 18. The upper surface 62 and the lower surface 64 intersect at a front edge 68, which is positioned at the front 24 of the upright body 18. Similarly, the upper surface 62 and the lower surface 64 intersect at a rear edge 70, which is positioned at the rear 26 of the upright body 18.

As shown, the base 60 includes a thickness Ti greater at the midline 66 than a thickness 12 at the front edge 68 or a thickness 13 at the rear edge 70, providing, in some embodiments, a sharp insertion point. In one embodiment, the variation in thickness arises from the upper surface 62 being a substantially horizontal surface and the lower surface 64 being a non-linear surface that is tapered from the midline 66 toward each of the front edge 68 and the rear edge 70. With this arrangement, each of the front edge 68 and the rear edge 70 provide an entry wedge, such as an entry wedge 72 and an entry wedge 74, sized for easier insertion between a tile and subsurface.

The base 60 may have any shape, including circular shapes, rectangular shapes, triangular shapes, or typographical shapes, like the letter "H" or "I." In one embodiment, the base 60 is an I-shaped base. Spaced and parallel strip members 76, 78 provide four points of contact 80, 82, 84, 86 for lift of tiles, while still establishing space for maximum mortar penetration between the spaced and parallel strip members 76, 78. Further, it should be appreciated that the base 60 may include base elements such as holes, openings, notches, grooves, and combinations thereof, for example. As shown, in one embodiment, the base 60 includes notches 88, 90.

In some embodiments, a base-to-body coupling 92 positioned at the intersection of the upright body 18 and the base 60 includes the frangible breakaway section 94. The upright body 18 and the base 60 are integral prior to frangible separation such that the frangible breakaway section 94, upon breaking, frangibly separates the upright body 18 and the base 60. The frangible breakaway section 94 may be a frangible section of the upright body 18 of reduced thickness that would promote the breakaway, and thus, separation of the upright body 18. The frangible breakaway section 94 may include one or more frangible breakaway section portions and may include features like small holes, tapered edges, and the like. By way of example, the base 60 may include a channel 96 at the base-to-body coupling 92. The channel 96 lowers the breakoff point at or below a top of the base 60.

In some embodiments, the wedge device 16 includes a backstop member 100 and a body member 102. As shown, the body member 102 may have an attachment end 104, a penetrating edge 106, a top 108, a bottom 110, and sidewalls 109, 111. The attachment end 104 is coupled to the backstop member 100 and the penetration edge 106 may be configured to penetrate the tile leveling device 14 at the guide surface 34. The body member 102 may include an inclined plane 112 tapering from the attachment end 104 to the penetrating edge 106. The body member 102 includes a longitudinal axis 114 from the attachment edge 104 to the penetrating edge 106. As depicted, the longitudinal axis 114 has a longitudinal length $L_1$.

A line-of-sight opening 116 extends along the longitudinal axis 114 and intersects the longitudinal length $L_1$ with the line-of-sight opening 116 having an opening length $L_2$ and an opening width $W_2$. The line of sight opening 116 is configured to be penetrated by the tile leveling device 14. In one implementation, the opening length $L_2$ is greater than the head width $W_1$ and the opening width $W_2$ is greater than the head depth $D_1$. In this manner, the opening width $W_2$ accommodates the perimeter 28 to permit rotational movement of the upright body 18 of the tile leveling device 14 within the line-of-sight opening 116. With this configuration, the tile leveling device 14 and the wedge device 16 may be interconnected by insertion then rotation, as shown by arrows $A_I$, $A_R$. The line-of-sight opening 116 also provides visibility through the body member 102 from the top 108 to the bottom 110. The inclined plane 112 may include a toothed surface 118. In operation, teeth forming the toothed surface 118 prevent the wedge device 16 from slipping out of contact with the left guide surface portion 36 and the right guide surface portion 38 forming the guide surface 34 during penetration thereof. As will be appreciated, the wedge device 16 may penetrate the tile leveling device 14 from the front 24 or rear 26.

In one embodiment, the body member 102 of the wedge device 16 includes a beveled edge 120 at an intersection of the bottom 110 and the line-of-sight opening 116. The beveled edge 120 and the flared portion 54 work with the clipped corners 50, 52, providing greater strength while accommodating multiple tile thicknesses as it allows the lower end 22 of the upright body 18 of the tile leveling device 14 to start at a higher point and disperse the applied pressure. In particular, the clipped corners 50, 52 improve and provide clearance between the head 32 and the beveled edge 120 when the tile leveling device 14 is selectively threaded through the line-of-sight opening 116 of the wedge device 16 as will be discussed in further detail hereinbelow. Further, as shown, the body member 102 at the penetrating edge 106 includes a closed end member 122 forming a closed loop 124 that provides a slotted wedge design. When the penetrating edge 106 fully engages the tile leveling device 14, the closed end member 122 interconnects inclined plane members 126, 128 of the inclined plane 112 to strengthen side-to-side placement of tiles by ensuring more uniformed distribution of forces of the tiles and ensuring that the inclined plane members 126, 128 are in the same vertical plane. For additional support, a base extension member 130 circumscribes the sidewalls 109, 111 and the backstop member 100. The base extension member 130 may also ensure more uniform distribution of forces on the tiles and ensure the inclined plane members 126, 128 stay within the same vertical plane, particularly in instances where three or four tiles are being installed. It should be appreciated that although a particular wedge device, the wedge device 16, is shown, the tile leveling system, including the tile leveling device 14, may be utilized with other types of wedge devices. By way of example and not by way of limitation, the wedge device 16 may have an open end rather than a closed end member at the penetrating edge, as will be presented below. In the open end embodiments, in some implementations, the open end defines a double headed wedge.

Figure 16A:
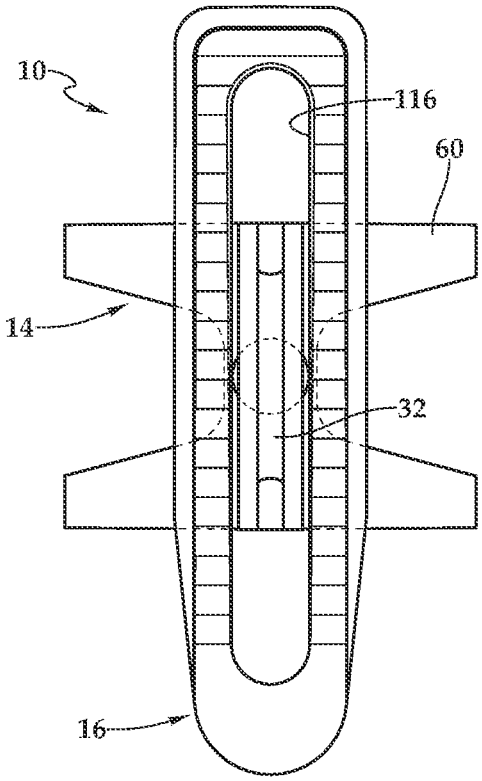
FIG. 16A is a top plan view of the tile leveling system presented in FIG. 2 in a first configuration.
Figure 16B:
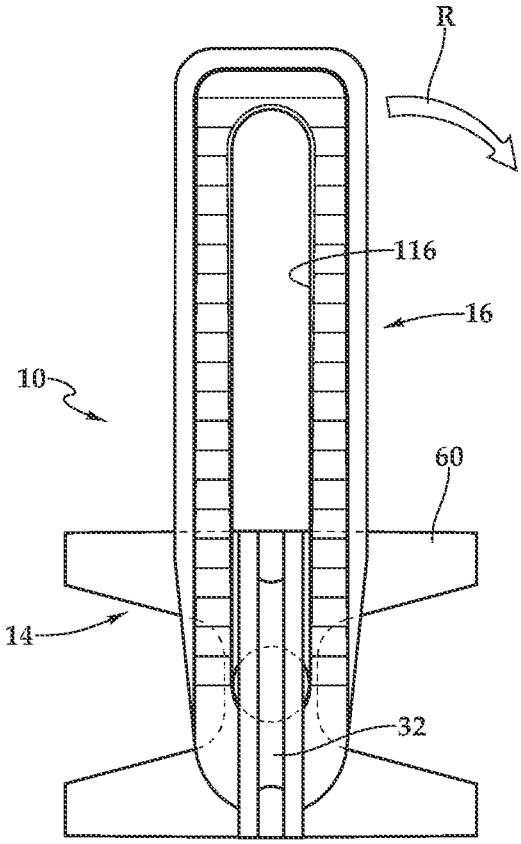
FIG. 16B is a top plan view of the tile leveling system presented in FIG. 2 in a second configuration.
Figure 16C:
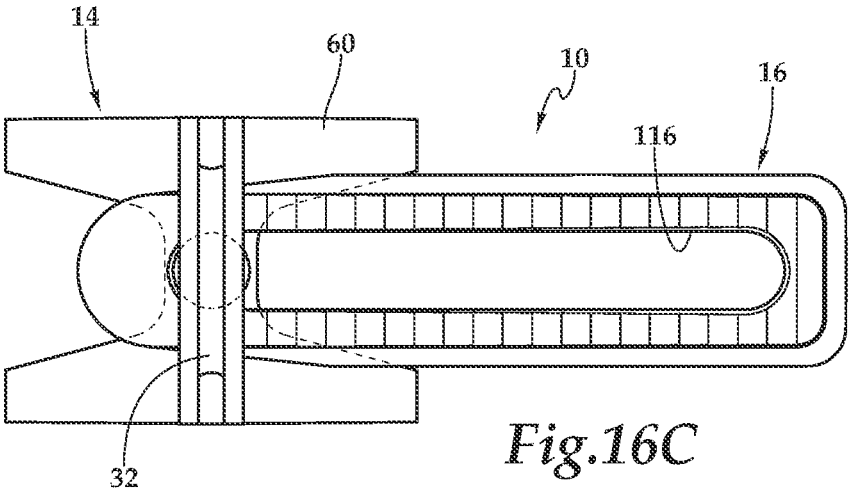
FIG. 16C is a top plan view of the tile leveling system presented in FIG. 2 in a third configuration.

Referring now to FIGS. 16A, 16B, and 16C, the tile leveling system 10 includes an operational configuration wherein the tile leveling device 14 is selectively threaded through the line-of-sight opening 116 of the wedge device 16. As seen best in FIG. 16A, the head 32 of the tile leveling device 14 is inserted through the line-of-sight opening 116 of the wedge device 16 proximate the penetrating edge 106 with the head width $W_1$ aligned with the opening length $L_2$. That is, as seen best in FIG. 16A, the line-of-sight opening 116 of the wedge device 16 may be placed over and the head 32 of the tile leveling device 14. Then, as best seen in FIG. 16B, the head 32 is rotated, as shown by arrow R, such that guide surface 34 is positioned perpendicular to the inclined plane 112 for contact with the inclined plane 112. Following the selective positioning of the tile leveling device 14 within the wedge device 16, as best seen in FIG. 16C, the tile leveling device 10 is ready for leveling operations.

Figure 17A:
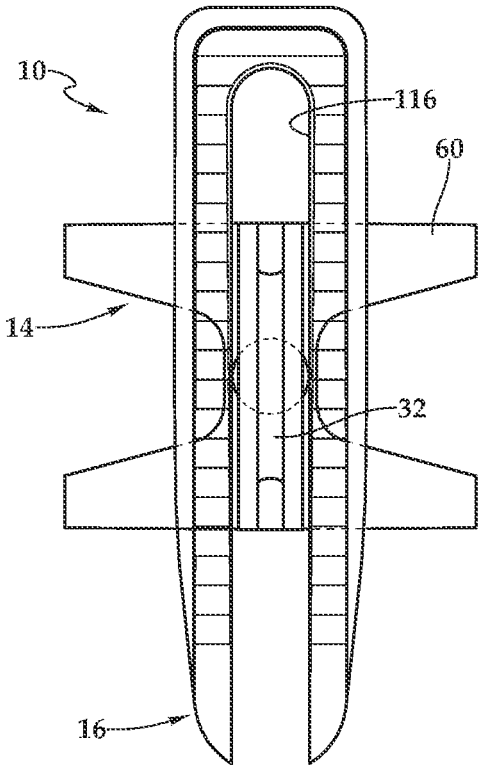
FIG. 17A is a top plan view of another embodiment of the tile leveling system presented in FIG. 2 in a first configuration.
Figure 17B:
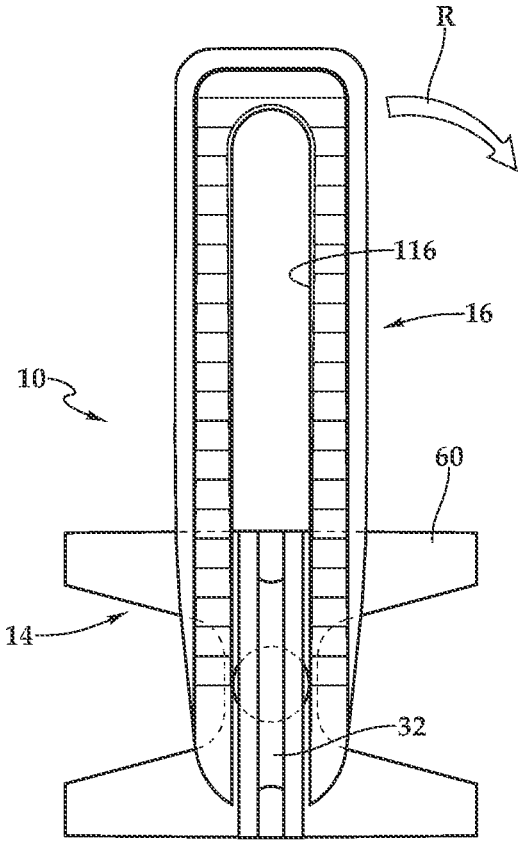
FIG. 17B is a top plan view of another embodiment of the tile leveling system presented in FIG. 2 in a second configuration.
Figure 17C:
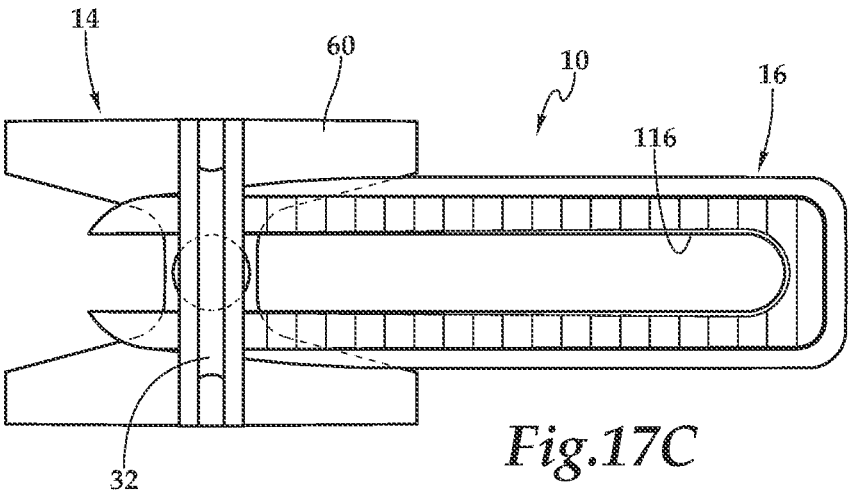
FIG. 17C is a top plan view of another embodiment of the tile leveling system presented in FIG. 2 in a third configuration.

Referring now to FIGS. 17A, 17B, and 17C, in another embodiment, the tile leveling system 10 includes an operational configuration wherein the tile leveling device 14 is selectively threaded through the line-of-sight opening 116 of the wedge device 16. As seen best in FIG. 17A, the head 32 of the tile leveling device 14 is inserted through the line-of-sight opening 116 of the wedge device 16 proximate the penetrating edge 106 with the head width $W_1$ aligned with the opening length $L_2$. Then, as best seen in FIG. 17B, the head 32 is rotated, as shown by arrow R, such that guide surface 34 is positioned perpendicular to the inclined plane 112 for contact with the inclined plane 112. Following the selective positioning of the tile leveling device 14 within the wedge device 16, as best seen in FIG. 17C, the tile leveling device 10 is ready for leveling operations.

Figure 20:
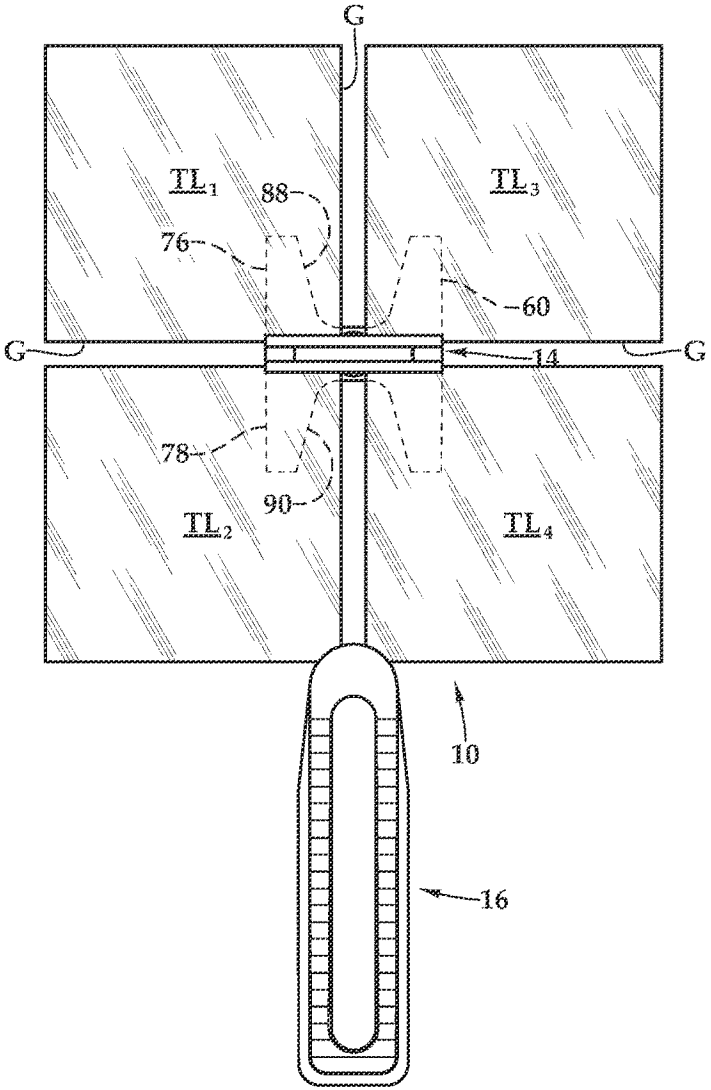
FIG. 20 is a top plan view of the tile leveling system presented in FIG. 1 and FIG. 2 being utilized in a four tile installation.
Figure 19:
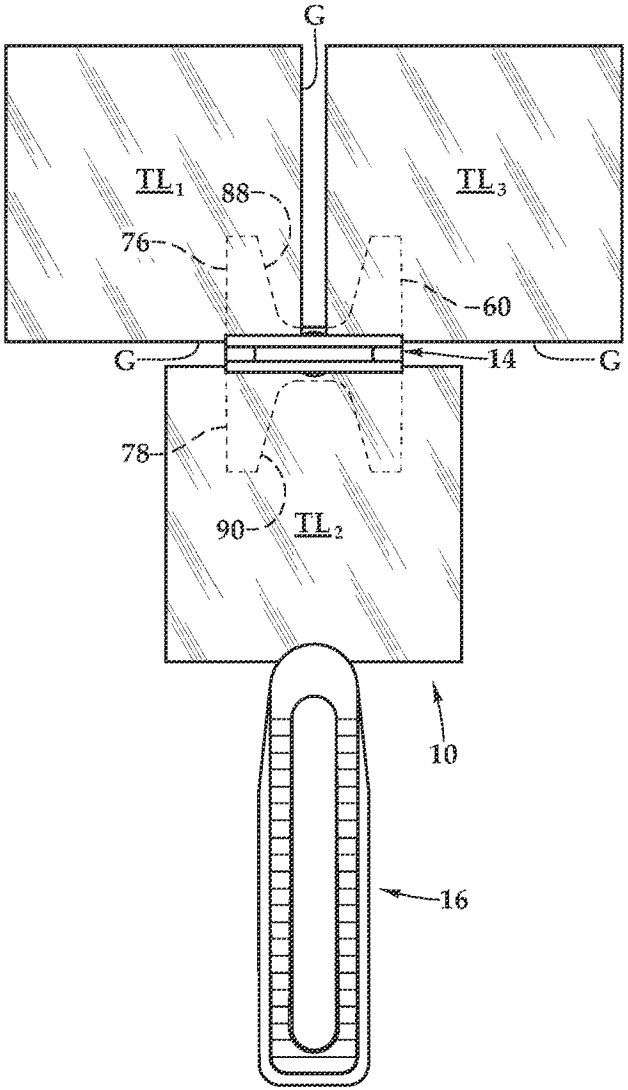
FIG. 19 is a top plan view of the tile leveling system presented in FIG. 1 and FIG. 2 being utilized in a three tile installation.
Figure 18:
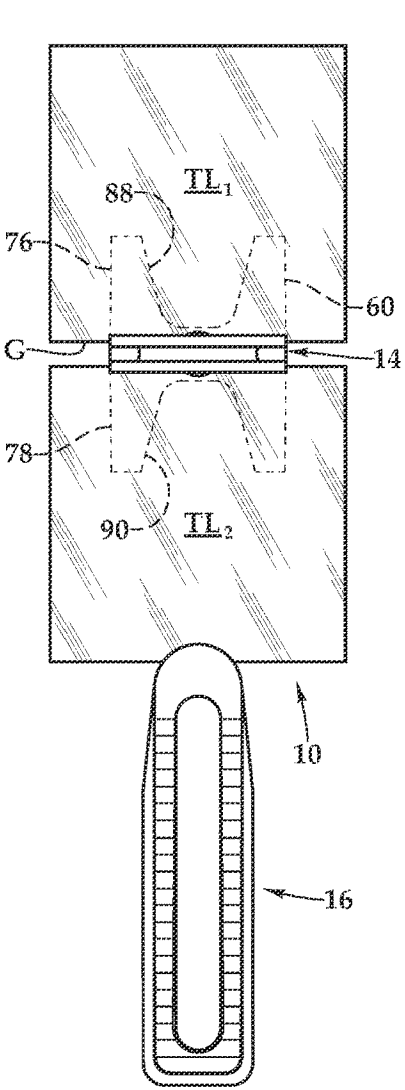
FIG. 18 is a top plan view of the tile leveling system presented in FIG. 1 and FIG. 2 being utilized in a two tile installation.

Referring now to FIG. 18 through FIG. 20, the tile leveling device 10 may be utilized with two tiles $TL_1$, $TL_2$ (FIG. 18), three tiles $TL_1$, $TL_2$, $TL_3$ (FIG. 19) or four tiles $TL_1$, $TL_2$, $TL_3$, $TL_4$ (FIG. 20) for installation on a substrate, subsurface, or other surface, which is indicated by the letter S having mortar M, as shown in FIGS. 21A through 21F. Grout lines G are located between each of the adjacent tiles. By way of example, with reference to FIG. 21A through FIG. 21F, in the two-tile installation, the tile $TL_1$ is positioned over the front portions of the spaced and parallel strip members 76, 78. The tile $TL_1$ has a lower surface opposite an upper surface, wherein the lower surface faces the spaced and parallel strip members 76, 78 and the subsurface S. The grout line G is the space between the two tiles $TL_1$, $TL_2$. The upper surface is farther from the spaced and parallel strip members 76, 78 than the lower surface and faces away from the spaced and parallel strip members 76, 78. The second tile $TL_2$ is similarly situated over the rear portions of the spaced and parallel strip members 76, 78 and includes a lower surface and an upper surface.

As shown, the tile $TL_1$ is over the base 60 to the front 24 of the upright body 18. As mentioned, the tile $TL_1$ has a lower surface opposite an upper surface. The tile $TL_1$ has contact with mortar M at the notch 88 (as best shown in FIG. 18), wherein the lower surface faces the base 60 and the upper surface is farther from the base 60 than the lower surface. Similarly, the tile $TL_2$ is over the base 16 at the rear 26 of the upright body 18. The tile $TL_2$ has similar surfaces to the tile $TL_1$ with mortar M at the notch 90 (as best shown in FIG. 18). The frangible breakaway section 94 may be located between the lower surface and the upper surface of the tile $TL_1$ and similarly positioned with respect to the tile $TL_2$.

Figure 21A:
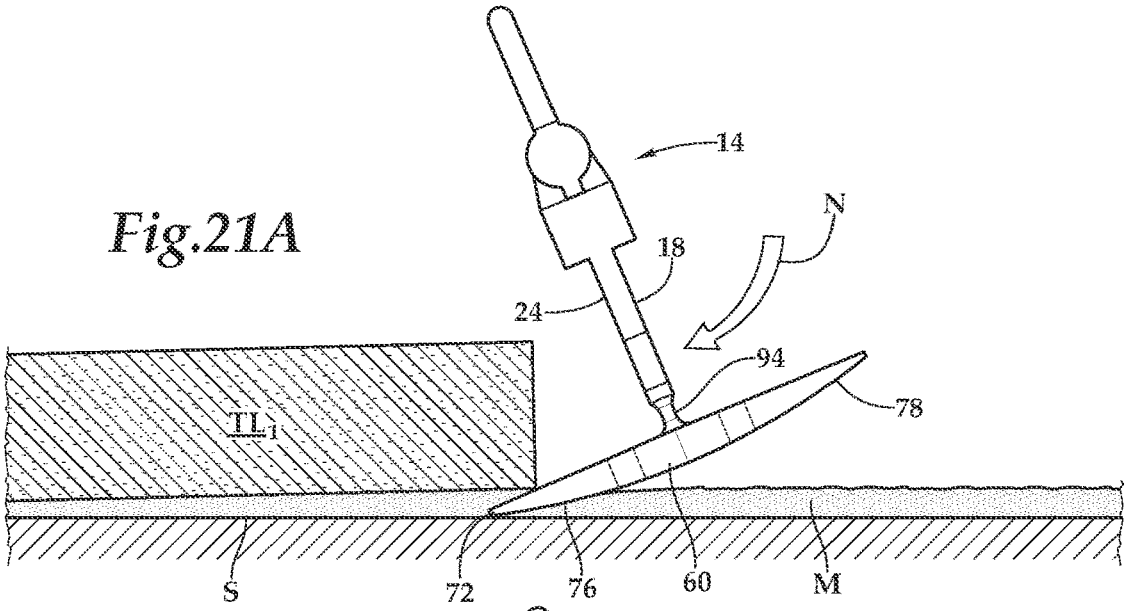
FIG. 21A is a side elevation view, in partial cross-section, of the tile leveling system of FIG. 1 and FIG. 2 being utilized to install tile at a first stage of installation.
Figure 21B:
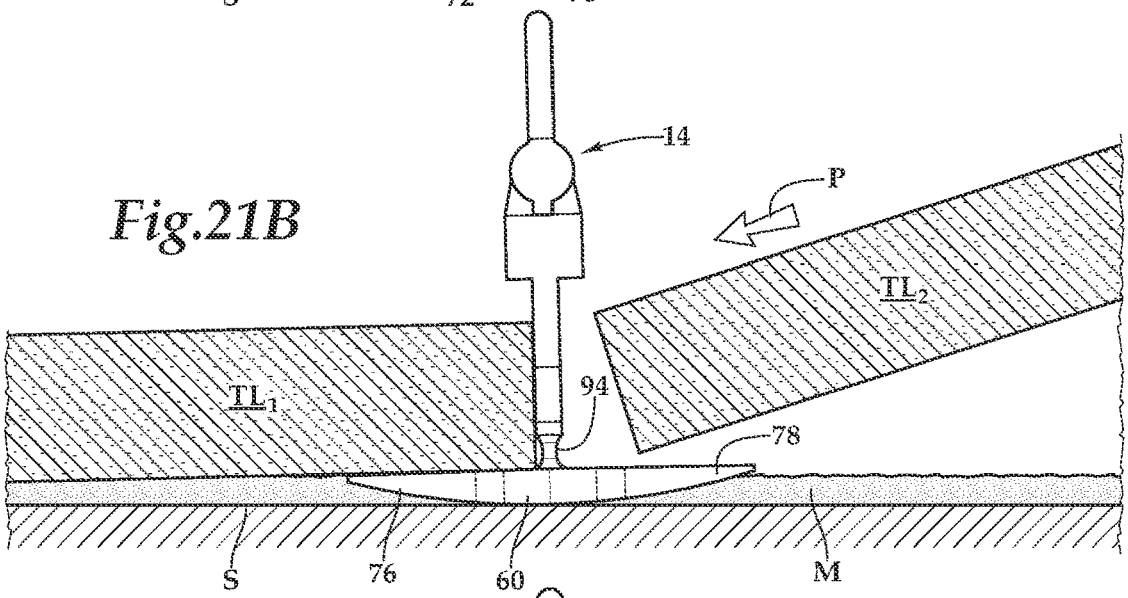
FIG. 21B is a side elevation view, in partial cross-section, of the tile leveling system of FIG. 1 and FIG. 2 being utilized to install tile at a second stage of installation.
Figure 21C:
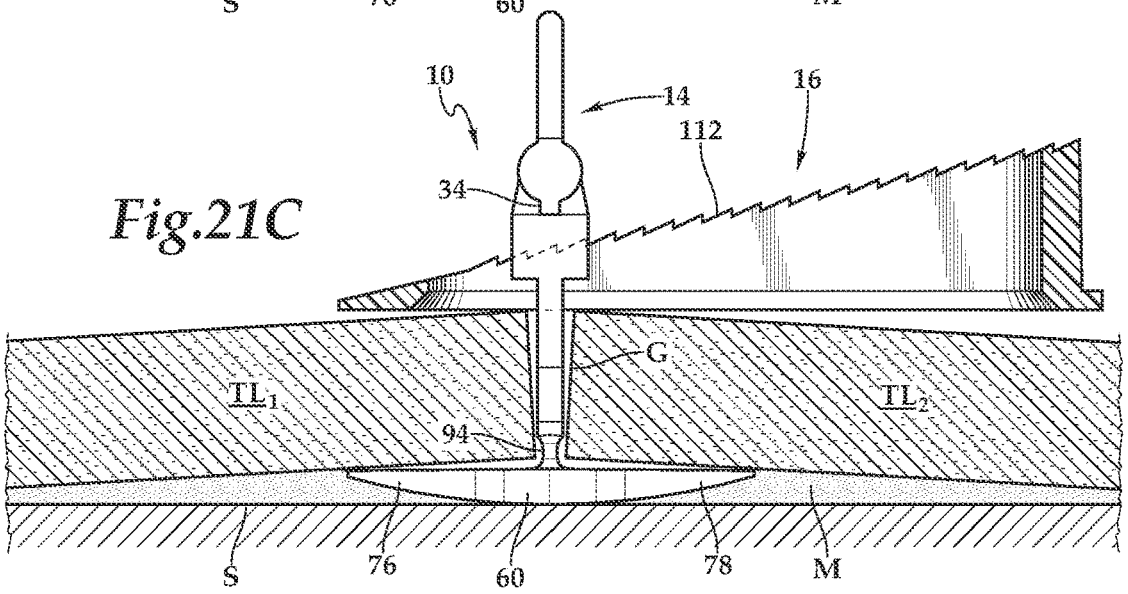
FIG. 21C is a side elevation view, in partial cross-section, of the tile leveling system of FIG. 1 and FIG. 2 being utilized to install tile at a third stage of installation.
Figure 21D:
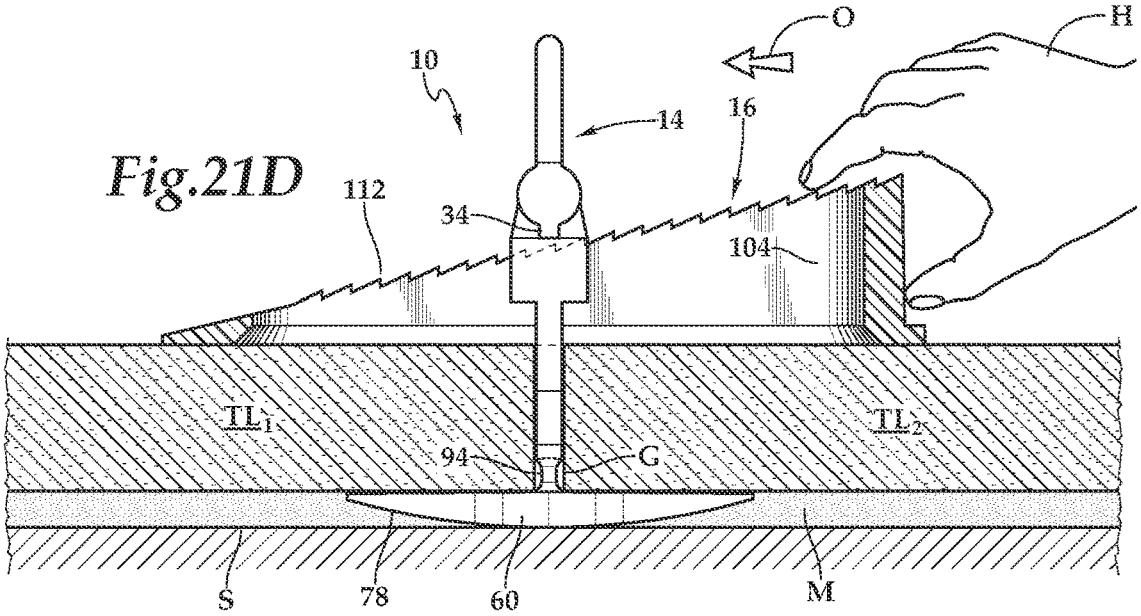
FIG. 21D is a side elevation view, in partial cross-section, of the tile leveling system of FIG. 1 and FIG. 2 being utilized to install tile at a fourth stage of installation.
Figure 21E:
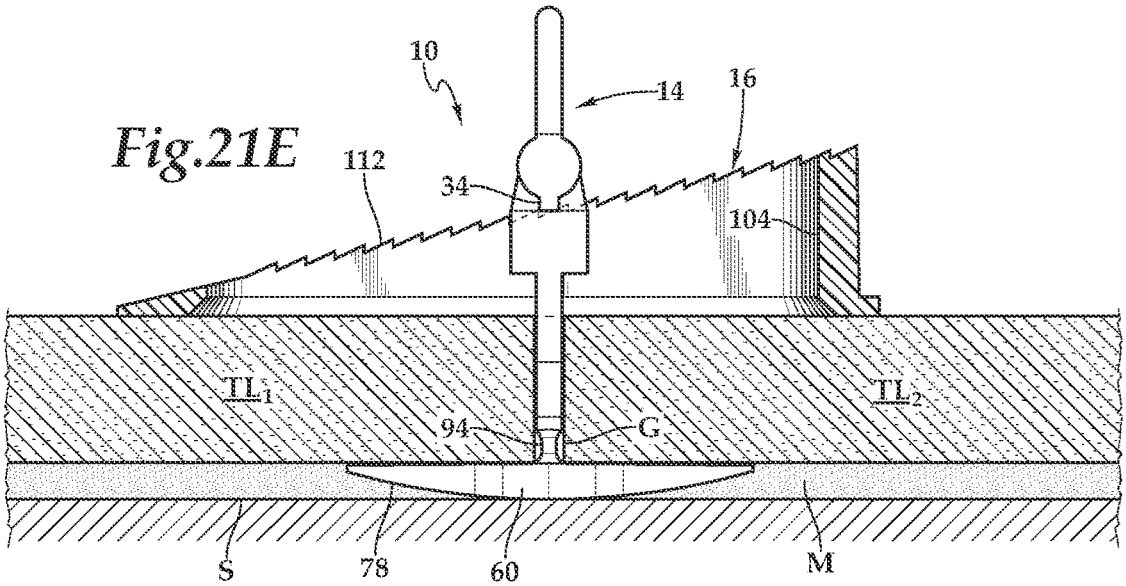
FIG. 21E is a side elevation view, in partial cross-section, of the tile leveling system of FIG. 1 and FIG. 2 being utilized to install tile at a fifth stage of installation.
Figure 21F:
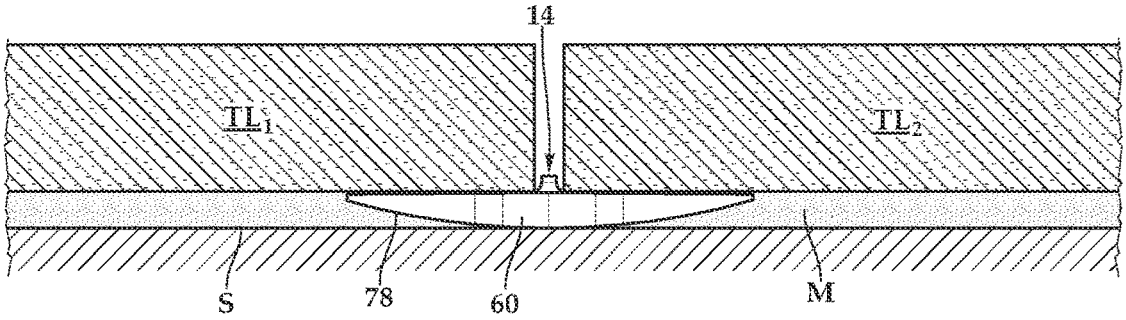
FIG. 21F is a side elevation view, in partial cross-section, of the tile leveling system of FIG. 1 and FIG. 2 being utilized to install tile at a sixth stage of installation.

In operation, an individual may place the tile leveling system 10, including the tile leveling device 14, on the subsurface S and then position the mortar M and desired number of tiles. As best seen in FIG. 21A, the entry edge 72 of the base 60 is utilized to place the base 60 of the tile leveling device 14 under the tile $TL_1$ using motion N to gently pry the tile $TL_1$ upward while the base slides under the tile $TL_1$ with minimum displacement of mortar M. As best seen in FIG. 21B, following the positioning of the tile leveling device 14 with the tile $TL_1$, tile $TL_2$ is placed with motion P onto the parallel strip members 78. Once the tile leveling device 14 and tiles are positioned following the positioning best seen in FIG. 21C, the tile leveling device 14 and the wedge device 16 are selectively interconnected, as previously discussed, in FIGS. 16A through 16C and FIGS. 17A through 17C. As best seen in FIG. 21D through FIG. 21F, as the inclined plane 112 is continually pushed by a hand H, as shown by a motion O, through the tile leveling device 14 under the guide surface 34, due to the increasing thickness of inclined plane 112 proximate the attachment end 104, the action causes the lower surfaces of each of the tiles $TL_1$, $TL_2$ to be compressed downward pressing the base 60 beneath the tiles 70, 72 toward the subsurface S, on which is located mortar M for bonding the tiles $TL_1$, $TL_2$ to the subsurface S. As a result, the tiles $TL_1$, $TL_2$ are aligned and leveled. The spacing between the tiles is controlled by the thickness of the upright body 18 and, in one embodiment, the presence of the spacers 46, 48. Once the tiles $TL_1$, $TL_2$ are set, the wedge device 12 may be removed and the upright body 14 is broken off by applying force to the side of the wedge device 16 such that the upright body 14 is severed at the frangible breakaway section 94. In the illustrated implementation, the frangible breakaway section 94 is positioned such that it is located between the upper and lower surfaces of the tiles $TL_1$, $TL_2$. That is, the frangible breakaway section 94 is located at a height within the thickness of the installed tiles. In this position, the frangible breakaway section 94 is not exposed to any adhesive that may be used to adhere the tiles to the subsurface S, which may be a floor or wall, for example, which may form a channel break off area.

Figure 22:
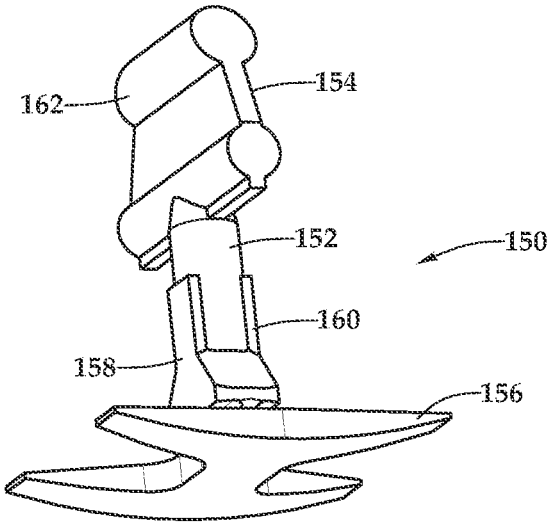
FIG. 22 is a perspective view taken from a bottom front angle of another embodiment of the tile leveling device, according to the teachings presented herein.
Figure 23:
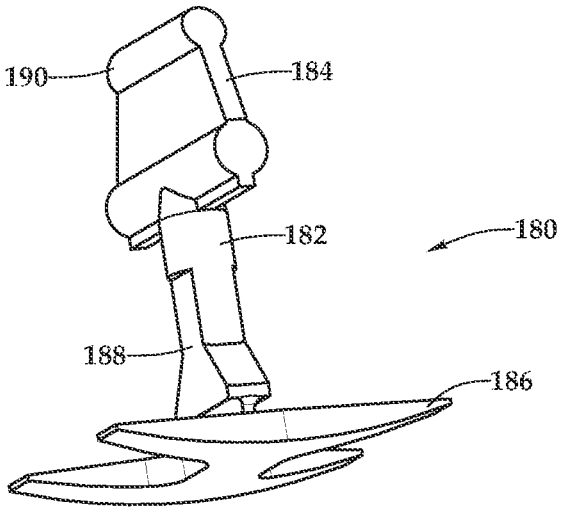
FIG. 23 is a perspective view taken from a bottom front angle of still another embodiment of the tile leveling device, according to the teachings presented herein.

Referring now to FIG. 22 and FIG. 23, it should be appreciated that variations in the tile leveling system 10 are within the teachings presented herein. By way of example, with reference to FIG. 22, and not by way of limitation, a tile leveling device 150 may include an upright body 152 having a head 154 coupled at one end and a base 156 coupled at the other end. As shown, in one embodiment, the upright body 152 includes spacers 158, 160. Also, the head 154 includes a handle 162. By way of further example, with reference to FIG. 23, a tile leveling device 180 may include an upright body 182 having a head 184 coupled at one end and a base 186 to the other end. As shown, the upright body 182 has enhanced thickness 188, which provides spacer functionality by incorporating a spacer thickness therewith. Additionally, the head 184 includes a handle 190.

As previously discussed, mechanical tile leveling systems have become increasingly popular. The tile leveling system 10 presented herein provides speed of operation through a simple system. Additionally, the present tile leveling system 10 decreases waste by providing a less wasteful, more compact solution. It is normal for thousands of clips to be used during a single tile installation job and as the tile leveling device 14 is intentionally divided in half at the base-to-body coupling 92, waste is created, including the upright body 18 and the head 32, for example. Compared to other tile leveling systems, the upright body 18 and the head 32 represent a reduction in the amount of waste as the upright 18 and the head 32 require approximately 75% less plastic than other mechanical tile leveling systems 10. Importantly, however, the reduced plastic does not compromise strength due to the design of the tile leveling device 14, including the upright body 18 interposed between the head 32 and the flared portion 54 that provide a wide bottom portion, strong pole portion, and wide top portion.

The order of execution or performance of the methods and techniques illustrated and described herein is not essential, unless otherwise specified. That is, elements of the methods and techniques may be performed in any order, unless otherwise specified, and that the methods may include more or less elements than those disclosed herein. For example, it is contemplated that executing or performing a particular element before, contemporaneously with, or after another element are all possible sequences of execution.

While this invention has been described with reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A tile leveling system comprising:

a tile leveling device including:

an upright body having an upper end and a lower end, the upright body having a perimeter therearound;

a head coupled to the upper end of the upright body, the head having a guide surface facing a base, the head having a head width and a head depth, the head providing subterminal opposition surfaces in which the palmar surfaces of a thumb and index finger can hold the head therebetween;

the base orthogonally coupled to the lower end of the upright body, the base extending to a front of the upright body and the base extending to a rear of the upright body; and a base-to-body coupling including a frangible breakaway section, the base and the upright body being integral prior to frangible separation, the frangible breakaway section, upon breaking, frangibly separating the base and the upright body; and a wedge device comprising:

a body member having an end, a penetration edge, a top, and a bottom, the penetration edge being configured to penetrate the tile leveling device at the guide surface;

the body member including an inclined plane tapering from the end to the penetration edge;

the body member including a longitudinal axis from the end to a penetrating edge;

a line-of-sight opening extending along the longitudinal axis and intersecting the longitudinal length, the line-of-sight opening providing visibility through the body member from the top to the bottom; and the line-of-sight opening having an opening length and an opening width, the opening length being greater than the head width, the opening width being greater than the head depth, the opening width accommodating the perimeter to permit rotational movement of the wedge device relative to the upright body.

2. The tile leveling system as recited in claim 1, wherein the head further comprises a spacer extending from the front of the upright body, the spacer configured to position a tile at a predetermined distance.

3. The tile leveling system as recited in claim 1, wherein the head further comprises a spacer extending from the rear of the upright body, the spacer configured to position a tile at a predetermined distance.

4. The tile leveling system as recited in claim 1, wherein the head further comprises a spacer extending from the front and the rear of the upright body, the spacer configured to position first and second tiles a predetermined distance apart.

5. The tile leveling system as recited in claim 1, wherein the perimeter further comprises a circumference.

6. The tile leveling system as recited in claim 1, wherein the base further comprises a first notch formed at the base extending to the front of the upright body and a second notch formed at the base extending to the rear of the upright body.

7. The tile leveling system as recited in claim 1, wherein the base further comprises base elements selected from the group consisting of holes, openings, notches, and grooves.

8. The tile leveling system as recited in claim 1, wherein the base further comprises a shape selected from the group consisting of I-shapes, circular shapes, rectangular shapes, triangular shapes, and typographical shapes.

9. The tile leveling system as recited in claim 1, wherein the base further comprises an upper surface and a lower surface extending from a midline of the base and intersecting at a front edge, the front edge being relative to the front of the upright body.

10. The tile leveling system as recited in claim 9, wherein the base further comprises a thickness greater at the midline than the front edge.

11. The tile leveling system as recited in claim 9, wherein the upper surface further comprises a substantially horizontal surface.

12. The tile leveling system as recited in claim 1, further comprising an operational configuration wherein the head of the tile leveling device is inserted through the line-of-sight opening of the wedge with the head width aligned with the opening length prior to the head being rotated such that the guide surface is positioned perpendicular to the inclined plane to contact the inclined plane.

13. The tile leveling system as recited in claim 1, wherein the body member of the wedge device further comprises a beveled edge at an intersection of the bottom and the line-of-sight opening.

14. The tile leveling system as recited in claim 1, wherein the head further comprises a clipped corner at an intersection of the head and guide surface.

15. The tile leveling system as recited in claim 1, wherein the inclined plane further comprises a toothed surface.

16. The tile leveling system as recited in claim 1, further comprising an operational configuration wherein the line-of-sight opening of the wedge is inserted over the head of the tile leveling device and therethrough such that the head width is aligned with the opening length prior to the head being rotated such that the guide surface is positioned perpendicular to the inclined plane to contact the inclined plane.

17. The tile leveling system as recited in claim 1, wherein the penetrating edge further comprises a closed end member.

18. The tile leveling system as recited in claim 1, wherein the penetrating edge further comprises an open end defining a double-headed wedge.

19. A tile leveling system comprising:

a tile leveling device including:

an upright body having an upper end and a lower end, the upright body having a perimeter therearound;

a head coupled to the upper end of the upright body, the head having a guide surface facing a base, the head having a head width and a head depth, the head providing subterminal opposition surfaces in which the palmar surfaces of a thumb and index finger can hold the head therebetween;

the base orthogonally coupled to the lower end of the upright body, the base extending to a front of the upright body and the base extending to a rear of the upright body; and a base-to-body coupling including a frangible breakaway section, the base and the upright body being integral prior to frangible separation, the frangible breakaway section, upon breaking, frangibly separating the base and the upright body; and a wedge device comprising:

a body member having an end, a penetration edge, a top, and a bottom, the penetration edge being configured to penetrate the tile leveling device at the guide surface;

the body member including an inclined plane tapering from the end to the penetrating edge;

the body member including a longitudinal axis from the end to the penetrating edge, the longitudinal axis having a longitudinal length;

a line-of-sight opening extending along the longitudinal axis and intersecting the longitudinal length, the line-of-sight opening providing visibility through the body member from the top to the bottom;

the line-of-sight opening having an opening length and an opening width, the opening length being greater than the head width, the opening width being greater than the head depth, the opening width accommodating the perimeter to permit rotational movement of the wedge device relative to the upright body; and in an operational configuration, the tile leveling device being selectively threaded through the line-of-sight opening.

20. A tile leveling system comprising:

a tile leveling device including:

an upright body having an upper end and a lower end, the upright body having a perimeter therearound;

a head coupled to the upper end of the upright body, the head having a guide surface facing a base, the head having a head width and a head depth, the head providing subterminal opposition surfaces in which the palmar surfaces of a thumb and index finger can hold the head therebetween;

the base orthogonally coupled to the lower end of the upright body, the base extending to a front of the upright body and the base extending to a rear of the upright body; and a base-to-body coupling including a frangible breakaway section, the base and the upright body being integral prior to frangible separation, the frangible breakaway section, upon breaking, frangibly separating the base and the upright body; and a wedge device comprising:

a body member having an end, a penetrating edge, a top, and a bottom, the penetration edge being configured to penetrate the tile leveling device at the guide surface;

the body member including an inclined plane tapering from the end to the penetrating edge;

the body member including a longitudinal axis from the end to the penetrating edge, the longitudinal axis having a longitudinal length; and a line-of-sight opening extending along the longitudinal axis and intersecting the longitudinal length, the line-of-sight opening providing visibility through the body member from the top to the bottom.

* * * * *